US007624776B2

(12) United States Patent
Zvirblis

(10) Patent No.: US 7,624,776 B2
(45) Date of Patent: Dec. 1, 2009

(54) STRUCTURE OF HANDBAG FOR FEMALE USAGE

(76) Inventor: Fabiola Andrade Zvirblis, Rua Fada Sayeg Seba, 305 - Portal das Colinas, Guaratinguetá (BR) 12516-330

( * ) Notice: Subject to any disclaimer, the term of this patent is extended or adjusted under 35 U.S.C. 154(b) by 379 days.

(21) Appl. No.: 11/636,490

(22) Filed: Dec. 11, 2006

(65) Prior Publication Data

US 2008/0135143 A1 Jun. 12, 2008

(51) Int. Cl.
*A45C 3/06* (2006.01)
*A45C 1/02* (2006.01)
*A45C 13/10* (2006.01)

(52) U.S. Cl. ..... 150/104; 150/118; 150/129; 190/107; 190/116; 190/901; 383/13; 383/71; 383/76

(58) Field of Classification Search ..... 150/103–105, 150/107, 100, 118, 129; 190/2.07, 116, 901; 383/13, 76, 907, 71, 72
See application file for complete search history.

(56) References Cited

U.S. PATENT DOCUMENTS 196,546 A * 10/1877 Spence et al. ..... 383/86
1,362,884 A * 12/1920 Matsusaki ..... 383/34
RE17,503 E * 11/1929 Reilly ..... 229/125.01
2,086,326 A * 7/1937 Goldberg ..... 2/66
2,284,212 A * 5/1942 Kanzow ..... 383/26
D140,551 S 3/1945 Deutz
D144,456 S 4/1946 Furst
2,578,391 A * 12/1951 Behr ..... 294/169
2,635,664 A * 4/1953 Cohen ..... 150/103
3,108,627 A * 10/1963 Tatelman ..... 150/103
3,550,663 A * 12/1970 Johnston ..... 150/103
D228,819 S 10/1973 Resnick
4,112,991 A * 9/1978 Barbaresi ..... 150/104
4,907,633 A * 3/1990 Eckstein ..... 150/105
4,991,978 A * 2/1991 Ostrowski ..... 383/4
5,490,478 A * 2/1996 Cole ..... 119/28.5

* cited by examiner

*Primary Examiner*—Sue A Weaver
(74) *Attorney, Agent, or Firm*—Bacon & Thomas, PLLC

(57) ABSTRACT

A handbag is substantially formed by a fabric piece (2) and closure hardware (11). The fabric piece (2) incorporates two alignments of passing openings (3), where each passing opening (3) is provided with a respective eyelet (4). The fabric piece (2) has its structure composed by an internal covering fabric (5), an internal structure fabric (gusset or similar) (6), and an external covering fabric (7). The fabric piece (2) has two mutually opposed borders (8) having an essentially arched contour. The two border portions (8) are joined by parallel mutually opposed rectilinear border portions (9). The two alignments of passing openings are respectively disposed along each one of the arched borders (8).

6 Claims, 4 Drawing Sheets

STRUCTURE OF HANDBAG FOR FEMALE USAGE

FIELD OF INVENTION

The present invention relates to a structure of a handbag which presents a simple and functional structure that allows for the easy replacement of some of its basic components, thus allowing for different combinations of items such as hardware and the piece or fabric body that composes the basic structure of the handbag.

BACKGROUND OF THE INVENTION

As is it common knowledge, handbags for female usage present a variety of models and constructive projects which may have influence from, not only stylish, but also due to material used in its manufacturing (leather, fabric, natural and synthetic fibers, etc.)

Summarizing, handbags belonging to state of art present, as a rule, a complex way of building and that, independently of the esthetical draw of the piece as a whole, do not allow possibility that the user may eventually substitute some of its main parts, thus changing its style, or in other words, once established the basic draw of the handbag, and having it been manufactured, the final product cannot be changed afterwards according to the consumer desire.

Current state of art contemplates an exemplar of a handbag known as "Bermuda Bag" which is essentially formed by one piece or body in a bag shape (main structure), which, in its opening or "mouth" presents borders with snap closure or similar that allow these borders to be folded around a structure in a shaft shape that integrates one piece (of two pieces) that acts as a handle.

The mentioned kind of handbag, although it allows separation between piece in a bag shape and pieces that act as handles, do not contemplate a form of building that makes it possible to use a variety of handle models that, together with the piece in a bag shape, may result in the possibility of a composition of models with a variety of styles.

This limitation prevents the handbag article to be acquired by consumer and afterwards it may suffer adequacies to consumer desire, such fact that limits the philosophy of using this kind of item.

SUMMARY OF THE INVENTION

Facing the particularities and limitations that involve handbags belonging to the state of art, it was developed a present structure of a handbag for female usage, which counts on a simple, functional project that is open to receive modifications from its user through replacement or changing of some of its basic components.

In general lines, the present patent aims to provide at the end a handbag for female usage that may be mounted and dismounted in a simple and fast way, and that for such possibility of mounting and dismounting may be altered by its user generating, then a variety of compositions among its main components (handles or hardware and the structure or fabric body).

The handbag herein described presents a basic structure formed by one piece of fabric with specific draw, which is formed by and external cover, a fabric of internal structuring (gusset or similar) and an internal covering fabric that acts as a lining.

The fabric piece that constitutes the handbag now related presents a geometrically defined draw and counts on two alignments of passing openings in one of each of its arched borders, being that each of the passing openings counts on a respective eyelet.

Each set of passing openings is crossed by a supporting shaft that integrates closure hardware that complement handbag mounting and that are responsible for its structuring in the final form, as well as its closure.

The invention now proposed (and that is related to the new structure of the handbag object of this patent) results in final product that is innovating, versatile and totally according to modern woman philosophy.

DESCRIPTION OF THE DRAWINGS

The handbag obtained from the structure now related may be better appreciated from drawings related below, in which.

DETAILED DESCRIPTION OF THE INVENTION

Figure 1:
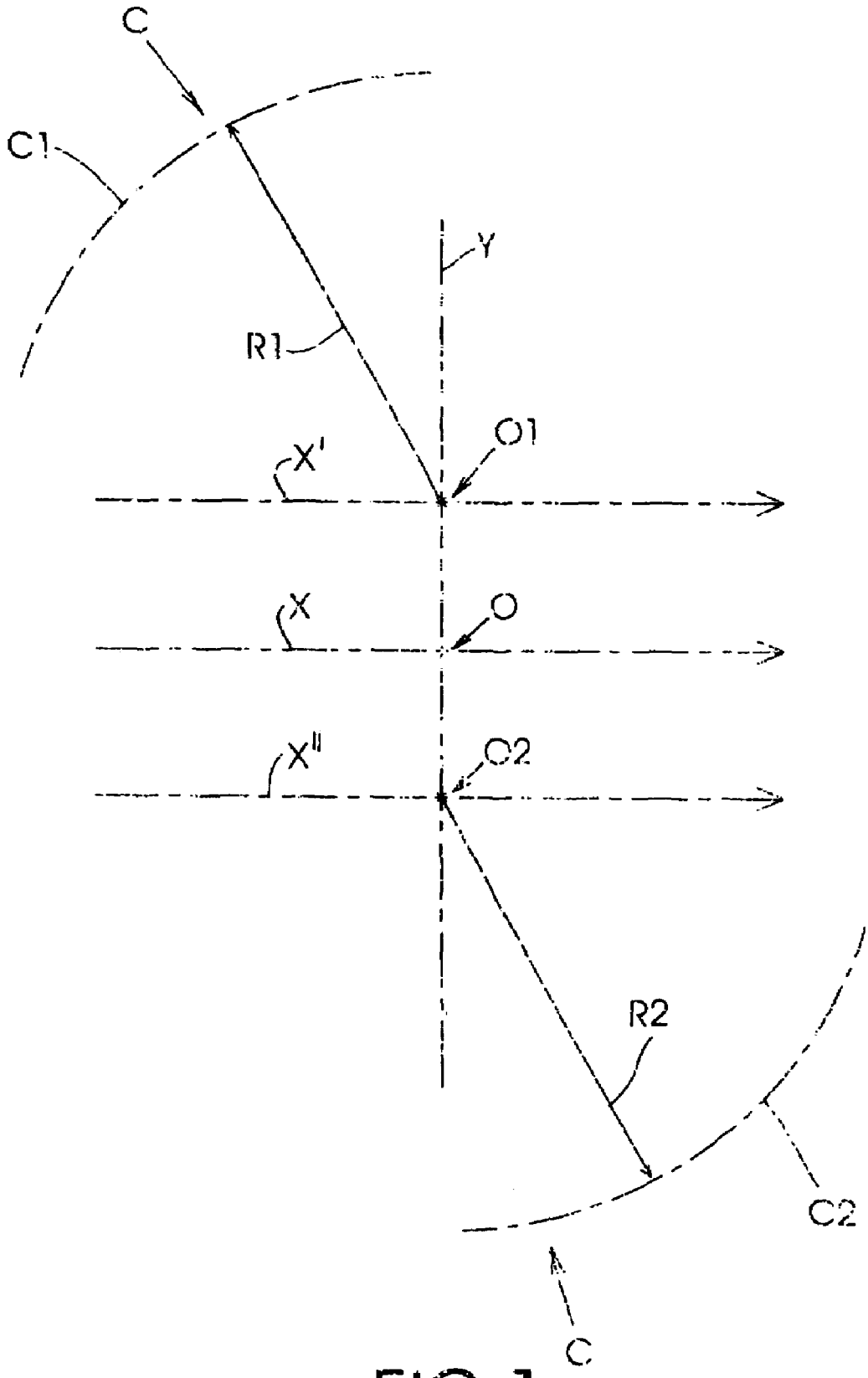
FIG. 1 illustrates a basic diagram that defines the geometry of the drawing in which the fabric piece is originated.

According to how much the hereinabove figures illustrates, the structure of the handbag that is approached by this invention results in a handbag 1 that is essentially formed by a fabric piece 2 that incorporates two alignment of passing openings 3, where each passing opening 3 is provided with a respective eyelet 4, item specially illustrated in FIG. 3, where the handbag 1 is observed in its form of final accomplishment.

Figure 4:
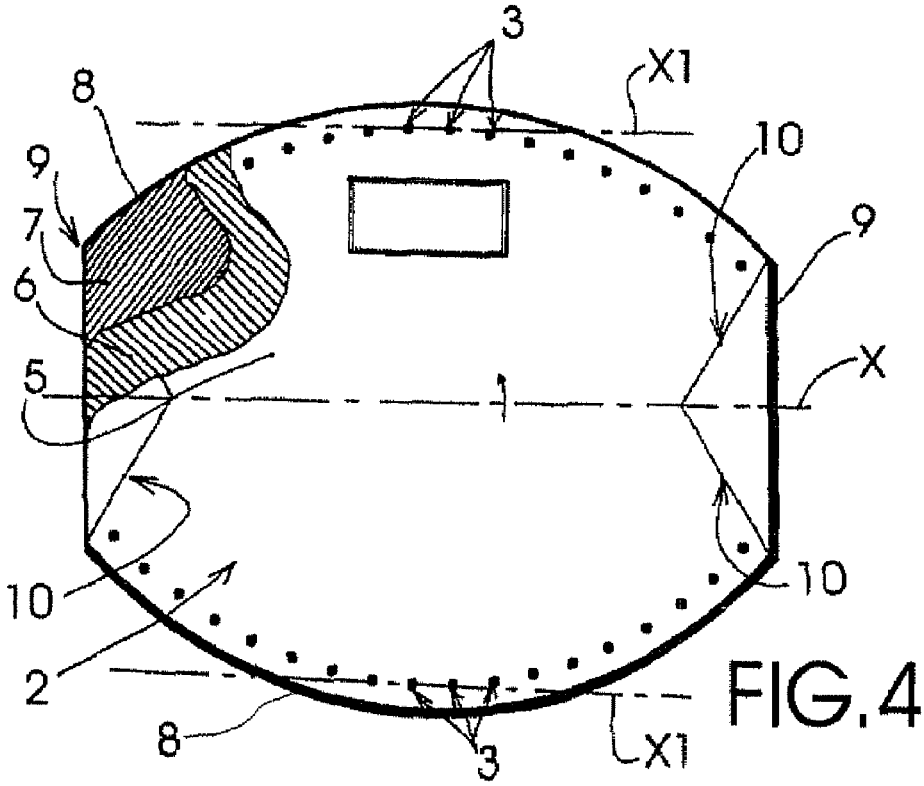
FIG. 4 illustrates a planned and partially cut view of the fabric piece that forms the basic structure of the referred handbag.

Fabric piece 2 may be appreciated in an isolated and planned way in FIG. 4, where it is showed from its internal face, being part of its structure showed in partial cut allowing being visualized the fact such structure is composed by an internal covering fabric 5 (that appear in first plan), an internal structuring fabric (gusset or similar) 6 (that appears in second plan), and an external covering fabric 7 (that appears in third plan) being that all fabrics are joined by techniques of conventional sewing about which it needs no explanation at all.

In an optional way, external covering fabric 7 may be replaced by other different materials (not fabric), such as leather, synthetic laminated, etc.

Fabric piece 2, as it can be further observed in FIG. 4 presents a draw that is defined by two borders mutually opposed 8 that present, each one, an essentially arched contour; or more specifically present a contour in circumference sector, being such borders mutually opposed 8 joined by small rectilinear borders 9 where such borders 9 are also mutually opposed and parallel, specially when the fabric piece 2 is in a planned condition, as showed in FIG. 4.

FIG. 4 further illustrate the fact the fabric piece 2 includes along each of the arched borders 8 alignments referring to the said passing openings 3, which follow the curvature or the borders 8.

Figure 5:
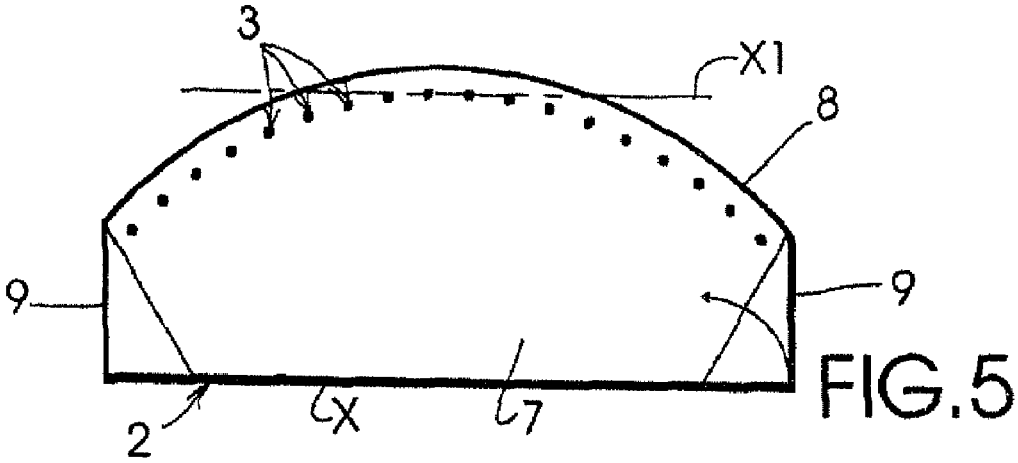
FIG. 5 illustrates a view of the fabric piece presented in the previous figure, being it folded along the longitudinal symmetry line.
Figure 6:
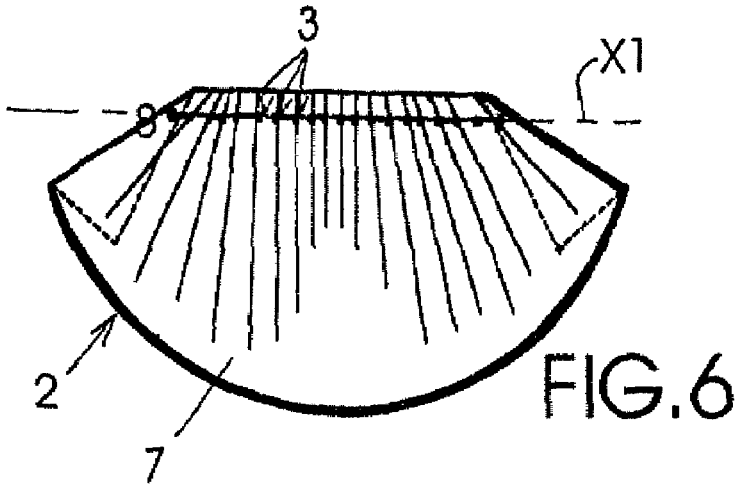
FIG. 6 illustrates, schematically, the alignment of passing openings of both sides of the handbag structure along two axles of parallel symmetry and that occur only when the piece of fabric is mounted on the handle hardware (only one of the axles may be visualized in the referred figure).

Fabric piece 2, in order to compose the said handbag form, is initially folded along its X longitudinal symmetry line such as in FIGS. 1 and 5, and afterwards it has its passing openings 3, after each one being provided with its respective eyelet 4, aligned along the two axles of parallel symmetry, indicated as X1 in FIG. 6 (only one of the axles of symmetry X1 can be visualized in the referred FIG. 6), moment in which it is defined the final general aspect of handbag 1.

In order to illustrate, the openings 3 that are showed in FIGS. 4, 5, and 6, are not yet provided with their respective eyelet 4.

Fabric piece 2 further incorporates two lines of folding 10 that start in the edge of each rectilinear border 9, in the region of transition in the said borders 9 with limits of arched borders 8 going towards X longitudinal symmetry line of the referred piece. Fabric piece 2 regarding to its specific geometry presents the drawing that may be visualized in FIG. 2.

Figure 2:
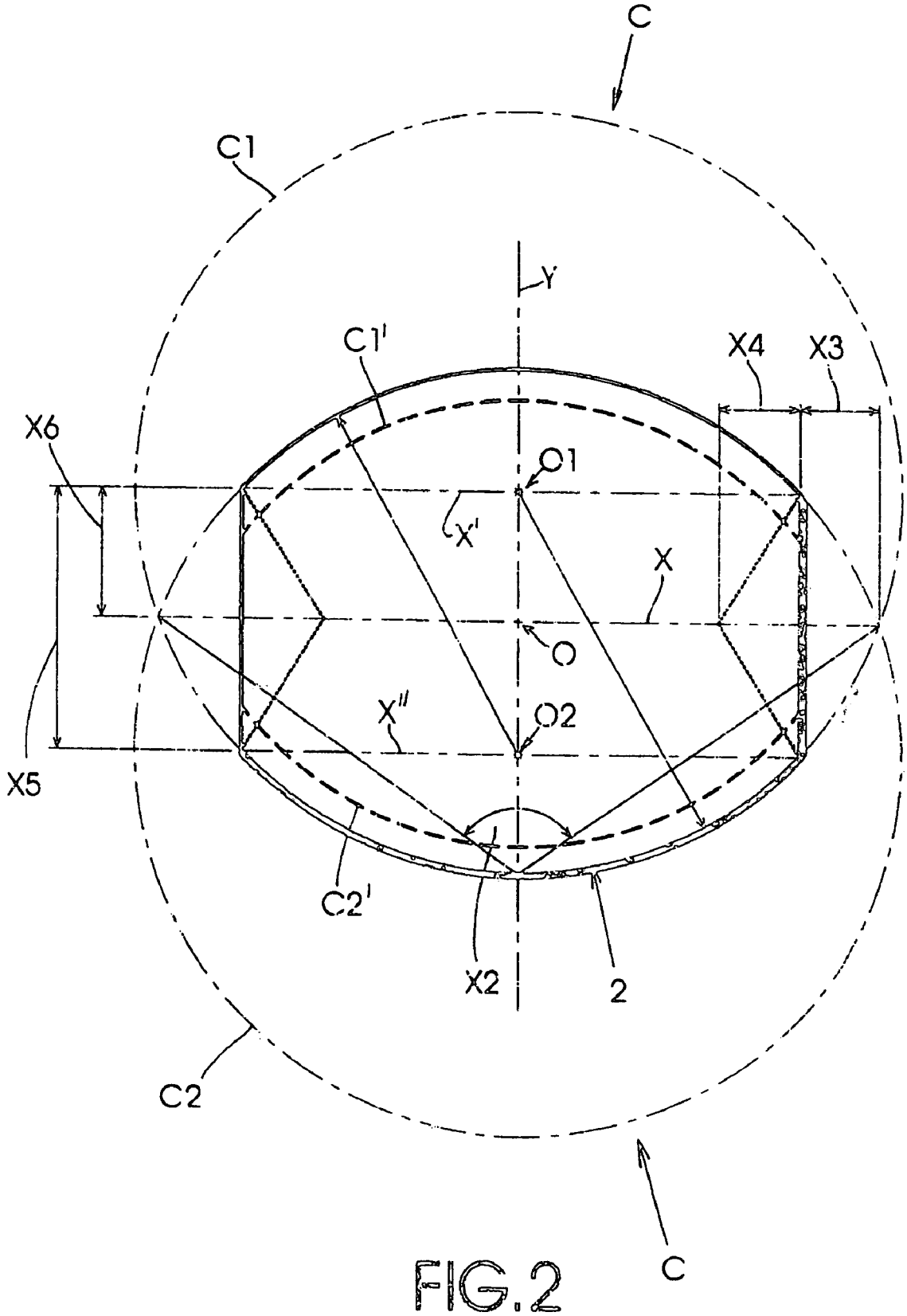
FIG. 2 illustrates a planned view and in a diagram form of a basic form of the fabric piece that constitute the essence of the handbag now mentioned, where it is indicated its main building lines.

Drawing of fabric piece 2, as showed in FIG. 2, is about the superposition of two circumferences C (indicated as C1 and C2) which are superposed in order to define in such region of superposition the area from which it is extracted the basic format of piece 2.

Basic geometry of the fabric piece 2 may be further extended regarding to FIG. 1 where it is presented a basic diagram that guides its drawing.

In FIG. 1 it is possible to visualize the circumferences C1 and C2 present a radius R (indicated as R1 and R2), being preferably radius R 45 cm.

Diagram of FIG. 1 is about a symmetry line X that is perpendicularly crossed by a transversal line Y, being the crossing point between lines X and Y indicated as an intersection point O, and up and down the intersection point O, along the transversal line Y, are marked intersection points O1 and O2, each one of them distant from the intersection point O by a measure of the distance that amounts ⅓ of the measure of the radius R that defines circumferences C1 and C2.

In fact, circumferences C (C1 and C2) start in intersection points O (O1 and O2) being the circumference C1 starting from intersection point O1, while the circumference C2 start in intersection point O2, as it can be understood through note in FIG. 1.

Intersection points O1 and O2 generate symmetry line X' and X" that are parallel to X longitudinal symmetry line, being such lines elongated in both directions from points O1 and O2 until the point in which cross respective passages of circumferences lines C1 and C2, defining, as a consequence, dimension of borders mutually opposed 8 and of rectilinear contour 9 as it can be better understood through note of FIG. 2.

The X longitudinal symmetry line, as it has already been told, is crossed in half of its length by a transversal or perpendicular symmetry line Y. In each of the sides of piece 2, in crossing points of line Y with circumferences C (C1 and C2), it is defined an angle X2 of 110° in relation of the crossing points of the same circumferences C as it can be visualized in FIG. 2, being the referred angle X2 to guide the distribution the passing openings 3.

Distance measure X3 that is defined between crossing point between the circumferences C (C1 and C2) and the rectilinear border 9 is used as a reference for definition in measure X4 that guides elaboration of folding line 10, such thing happening on both sides of piece 2.

The same FIG. 2 further allows observing the length measure X5 of each one of the rectilinear borders 9 is defined as two times the length measure X6 that starts on symmetry line X and extends to the point of meeting between rectilinear border 9 and opposed border 8 in each one of the piece sides 2, having in mind that measure X6 are equals the distance measure of ⅓ of radius R for they correspond to distance between intersection points O1 and O, as well O2 and O.

The same FIG. 2 further allows observing the intersection points O1 and O2 that define points from where it starts circumference C (C1 and C2) radius R guide circumference lines C1' and C2' along which the opening 3 are in an equidistant way distributed.

Figure 3:
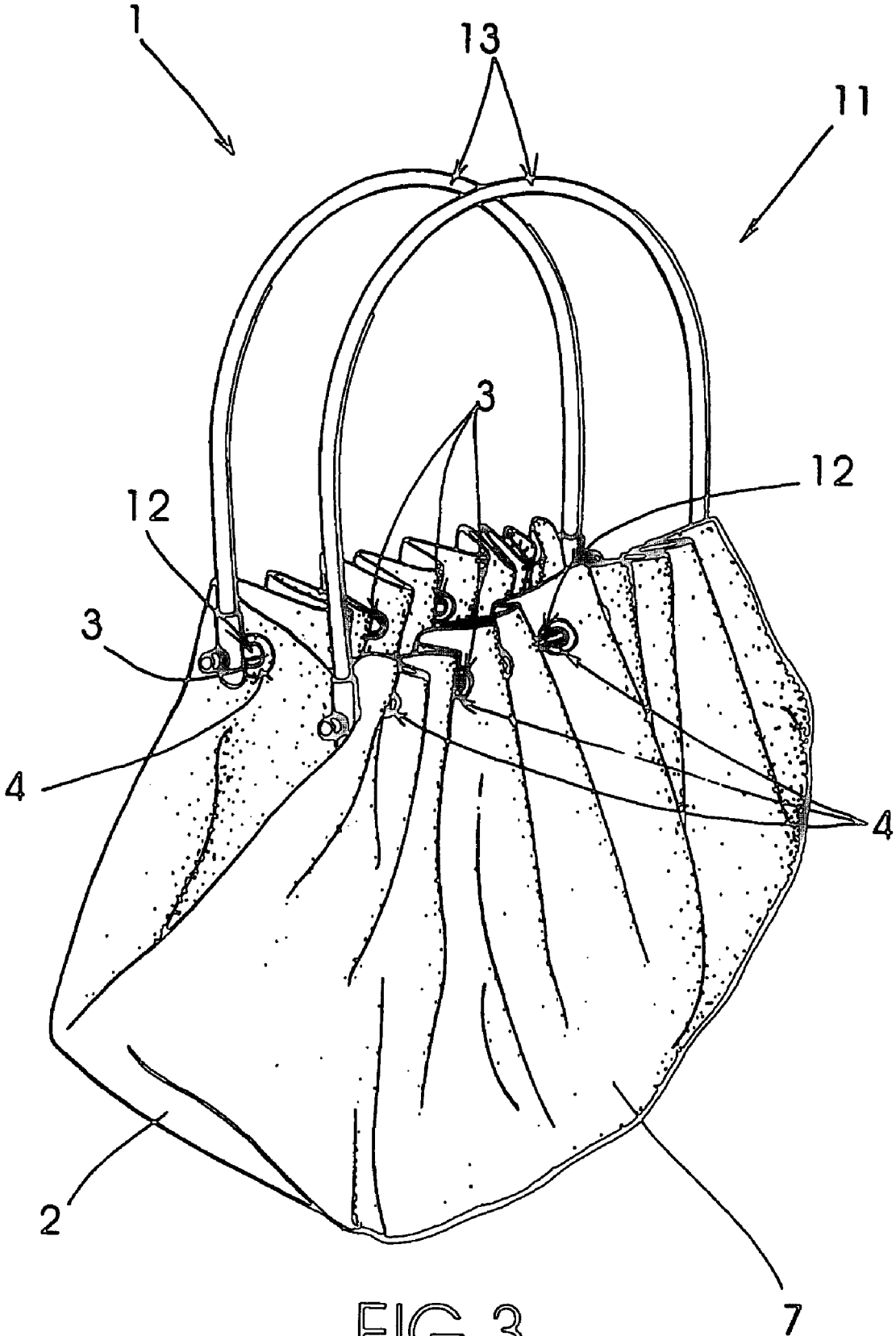
FIG. 3 illustrates a perspective view of the mentioned handbag, being it complemented with a set of hardware that includes two arched handles given as a non-limitative example.

Fabric piece 2 then defined is planned developed so that when it is mounted the handbag 1, it assume the general form showed in FIG. 3.

Handbag 1 is complemented by closure hardware 11 that includes, essentially, supporting shafts 12 that cross and align passing openings 3 defining then lines or axles of symmetry X1, said supporting shafts 12. The handles 13 are attached in its free edges, these handles can be arched shaped as FIG. 1 as well as may present a variety of forms and/or drawings.

Closure hardware 11 are defined in a way that its handles 13 may be mounted and dismounted from its supporting shafts 12, in a way the mentioned supporting shafts 12 may be withdrawn from passing openings 3.

Such possibility of dismounting allows the user may match the closure hardware 11 from a handbag 1 with the ones from one or more fabric pieces 2 (with other patterns, colors, finishing or made from other materials) from another exemplar of the same handbag and vice-versa.

The way the construction hereinabove presented allows the user to be able to use also spare closure hardware or fabric pieces 2 that may represent different "patterns" (or also "external covering") allowing then to be modified, with the replacements, the final embodiment of the handbag 1 according to the user desire.

Such characteristic of allowing modifying the final embodiment of handbag (composition between fabric piece 2 and closure hardware 11), already embodies as an innovation when the handbag now referred is compared to similar articles belonging to state of art.

It is important to emphasize the solution of the project herein adopted does not modify the handbag project itself, enabling the handbag user just the possibility of modifying final embodiment of the piece as a whole.

Also regarding to present project, it may be emphasized a positive characteristic that results in the fact that, according to the state of art, where conventional fabric handbags normally are not foldable, in the present case, when dismounted, the handbag herein proposed may have its fabric part folded, which allows a great reduction in needed space to keep it.

In an optional way, supporting shafts 12 may count on spacer pieces (not illustrated) that are mounted on it, between each eyelet, allowing then the fabric piece to assume a large framed shape. Spacer pieces present simple construction and may be from small sectors of tubes, stones and other decorative pieces.

In an optional way now referred it may further include a partition or pocket specially created for putting a mobile phone.

It is also an optional condition of the handbag now referred that its fabric piece 2 may be manufactured in a way to present two different parts in which each one of the faces may be used by the external side, adopting then the concept "double-faced" for such article.

The invention claimed is:

1. A handbag, comprising:

a fabric piece (2) including:

an internal covering fabric (5), an internal structure fabric (6) outside of the internal covering fabric (5) and an external covering fabric (7) outside of the internal structure fabric (6), wherein the internal covering fabric (5), the internal structure fabric (6) and the external covering fabric (7) are sewn together;

two opposing border portions (8) each having an arched contour, the two border portions (8) being joined by two parallel mutually opposed rectilinear border portions (9), wherein a longitudinal symmetry line (X) intersects the two rectilinear border portions (9);

two rectilinear folding lines (10) extending from two edge portions of each of the rectilinear border portions (9), wherein the two rectilinear folding lines intersect at the longitudinal symmetry line (X); and two alignments of passing openings (3) formed in the fabric piece (2), each passing opening (3) having a respective eyelet (4), wherein the two alignments of passing openings (3) are respectively disposed along one of the two arched border portions (8); and a closure member (11) extending through the passing openings (3).

2. The handbag according to claim 1, wherein the passing openings (3) are formed by folding the fabric piece along the longitudinal symmetry line (X) and thereafter forming the passing openings (3) in the fabric piece (2).

3. The handbag according to claim 1, wherein the border portions (8) each form portions of respective overlapping first and second circles having a first circumference (C1) and a second circumference (C2), respectively, the first and second circles having first and second radiuses (R1) and (R2), respectively, a vertical symmetry line (Y) intersects the border portions (8) at a vertex of an angle (X2) of 110°, the angle (X2) is formed by sides which respectively extend from the vertex to two intersecting points of the first and second circles, and wherein the longitudinal symmetry line (X) intersects the vertical symmetry line (Y) at a first intersection point (O), second and third intersection points (O1) and (O2) are respectively disposed above and below the first intersection point (O) along the vertical symmetry line (Y) spaced from the first intersection point (O) by a first distance defined as ⅓ of the radiuses (R1) and (R2).

4. The handbag according to claim 3, wherein the first and second circumferences (C1) and (C2) are generated from the second and third intersection points (O1) and (O2) being that the first circumference (C1) is generated directly from the second intersection point (O1), while the second circumference (C2) is generated from the third intersection point (O2); the second and third intersection points (O1) and (O2) generate first and second symmetry lines (X') and (X") that are parallel to the longitudinal symmetry line (X), wherein the first and second symmetry lines (X') and (X") are elongated on both directions from the second and third intersection points (O1) and (O2) until the point in which they cross the respective passages of the first and second circumferences line (C1) and (C2), defining, as a consequence, the arched border portions (8); the longitudinal symmetry line (X) is crossed at half of its length by the vertical symmetry line (Y) being that from the crossing point between vertical symmetry line (Y) and the first and second circumferences (C1) and (C2), in each one of the sides of the piece (2) is defined the angle (X2) that coincides also with crossing points of the first and second circumferences (C1) and (C2); a distance measure (X3) that is defined between the crossing point between the first and second circumferences (C1) and (C2) and the rectilinear border portions (9) is used as reference for definition of a distance (X4) that guides elaboration of the folding line (10) on both sides of the piece (2); a length measure (X5) of each one of the rectilinear border portions (9) is defined as twice a length measure (X6) that starts from the longitudinal symmetry line (X) and extends to the meeting point between the rectilinear border portions (9) and a respective border portion (8).

5. The handbag according to claim 1, wherein the closure member (11) includes supporting shafts (12) which extend through the passing openings (3) and handles (13) which are attached to end portions of the supporting shafts (12).

6. The handbag according to claim 1, wherein the fabric piece (2) is reversible.

* * * * *